United States Patent [19]

Wright

[11] 4,211,038

[45] Jul. 8, 1980

[54] ROLLER DROP DOOR

[75] Inventor: Glenn L. Wright, Canfield, Ohio

[73] Assignee: The Youngstown Steel Door Company, Cleveland, Ohio

[21] Appl. No.: 895,987

[22] Filed: Apr. 20, 1978

[51] Int. Cl.[2] ..... E05D 15/56

[52] U.S. Cl. ..... 49/234

[58] Field of Search ..... 49/234, 235

[56] References Cited

U.S. PATENT DOCUMENTS

| | | | |
|---|---|---|---|
| 515,248 | 2/1894 | Phipps | 49/234 |
| 2,027,599 | 1/1936 | Madland | 49/234 |
| 2,124,040 | 7/1938 | Olander | 49/235 |
| 2,348,369 | 5/1944 | Small | 49/234 X |

FOREIGN PATENT DOCUMENTS

| | | | |
|---|---|---|---|
| 645016 | 3/1964 | Belgium | 49/234 |

*Primary Examiner*—Kenneth Downey

*Attorney, Agent, or Firm*—John H. Mulholland

[57] ABSTRACT

A railway house car having a door supporting track on a car side beneath a door opening, a door formed with a lower edge surface for support of the door on the top of the track and to provide a good light seal when the door is in the closed position. The edge surface has a plurality of openings with a portion of a roller extending from each one. Corresponding copes are located in the top of the track to receive the roller portions when the door is in the closed position. The rollers and corresponding copes permit at least two rollers to engage the top of the track and support the door for movement when the door is in other positions on the track than the closed position. A door leverage or force-multiplying mover is selectively interconnected to the door by means of a hasp to initially move the door from the closed position. Alternatively, a fulcrum is provided so that a pry bar can manually engage a bottom retainer to accomplish the initial door movement. The track is welded throughout its length minimizing damage during loading and unloading operations and to prevent any portion of the door from being wedged between the car side and the track.

2 Claims, 6 Drawing Figures

ROLLER DROP DOOR

BACKGROUND OF THE INVENTION

The invention relates to a railway house car and particularly to railway box cars provided with so-called "sliding doors". The term "sliding doors" includes doors movable down a track on rollers. Three important considerations in sliding doors are their ability to give a tight water and light seal, their ability to withstand damage during loading and unloading operations and their simplicity and ease of operation.

Some prior art roller lift doors have obtained the lower seal by setting the lower edge of the door directly on a track when the door is in the closed position and providing a force-multiplying, lifting mechanism to force rollers out of openings in the lower edges and lift the door edge from the track to accomplish movement of the door along the track. Other prior art doors have been mounted on rollers and latched in position and provided with a sealing projection extending downwardly between the track and the car side.

A car which sits with the lower edge of the door on the track creates an excellent seal but heretofor has required an elaborate mechanical lifting mechanism. These types of doors did provide an advantage that the track could be sealed against the car side throughout its length, which is not the case where a sealing projection is needed between the track and the car side. In the novel structure of the invention, in addition to the improved seal by having the track secured throughout its length to the car side, it is not possible for the track to be forced inwardly toward the car side to wedge and clamp a downwardly projecting sealing portion of the door as is the case where the track is separated from the car side along its length and a sealing projection provided.

Accordingly, the instant invention provides a door which seals on its lower edge but does not require an elaborate lifting mechanism, yet retains an advantage that the track may be sealed throughout its length along the car side thus giving an excellent water and light seal of reduced maintenance requirement over that of the prior art.

SUMMARY OF THE INVENTION

The invention is a railway house car having a door supporting track on a car side beneath the door opening. A door is provided with a lower edge surface for support of the door on the top of the track when the door is in position to close the opening. The edge surface has a plurality of openings with portions of a plurality of rollers extending therefrom. Corresponding copes are provided in the top of the track located such that they receive the roller portions when the door is supported on the edge surface in position to close the opening. The rollers and corresponding copes are located to permit at least two rollers to engage the top of the track and support the door for movement when the door is in other positions on the track.

The edge surface of the door defines the innermost portion of the door adjacent the track such that a seal is provided and damage to the track cannot clamp or wedge a door portion between the track and the car side to prevent or hinder its selective door movement. The rollers may be of two diameters with rollers adjacent either end of the edge surface being of the same diameter.

A leverage-producing means either in the form of a door starter or a car side mounted fulcrum and pry bar are used to create initial movement of the door from the closed position. As the door moves down the track, the location of the rollers and copes is such that at least two rollers are always on the track. Moreover, the door is protected if left unlocked during car movement and the door will tend to stay in the closed position because of the track copes retaining the rollers.

DETAILED DESCRIPTION OF THE PREFERRED EMBODIMENT

Figure 1:
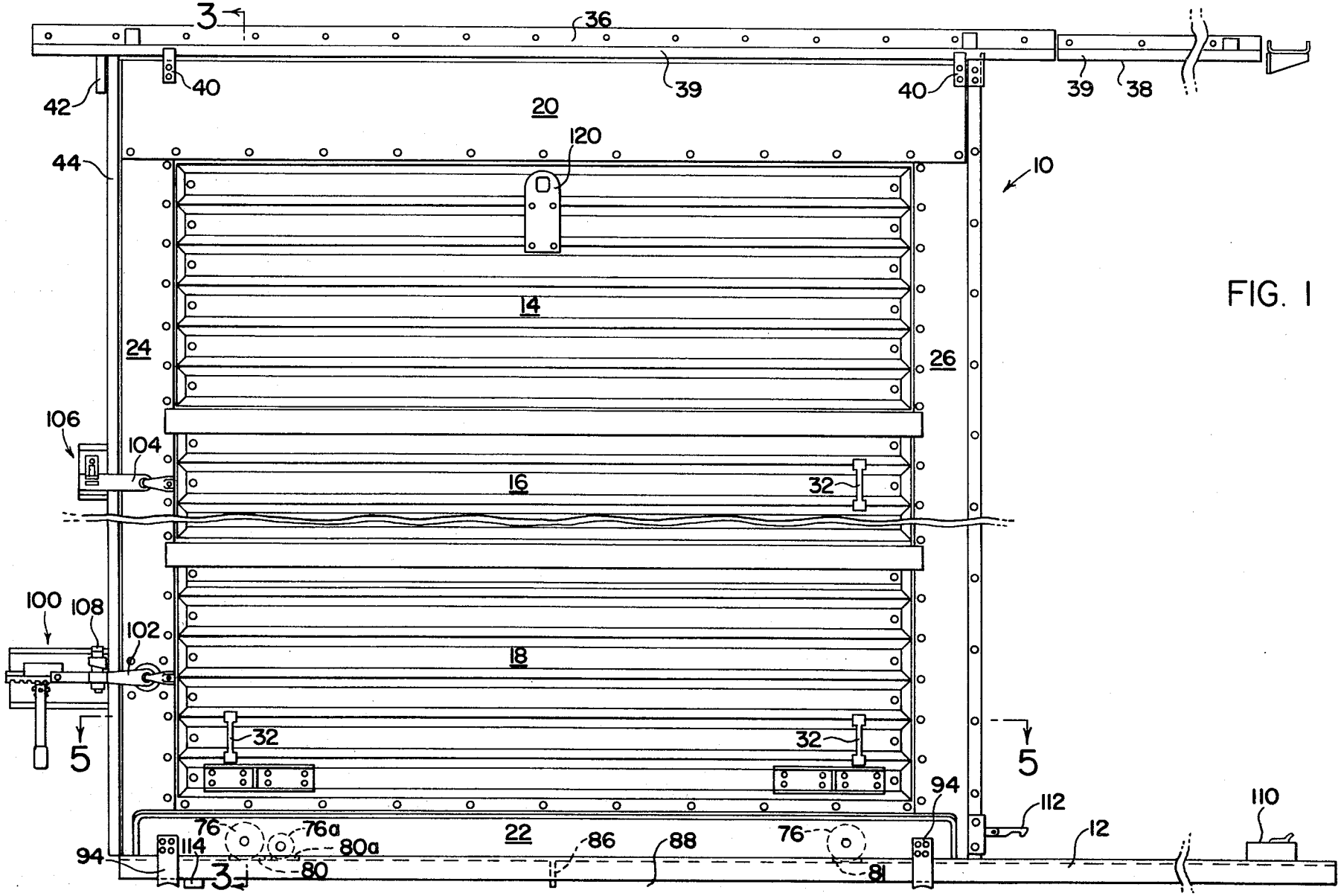
FIG. 1 is a side elevational view of the door mounted on a track in closed and locked position.
Figure 2:
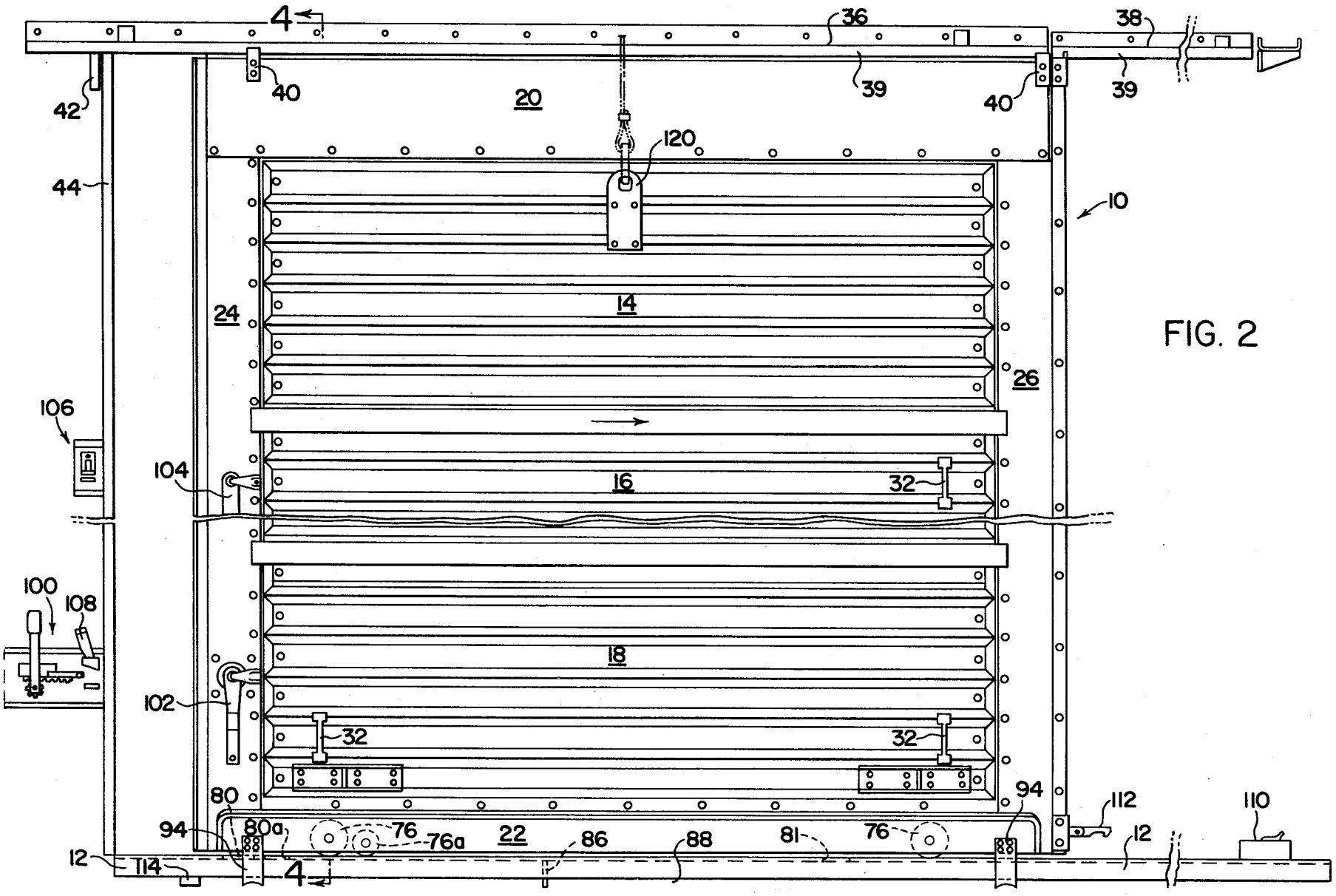
FIG. 2 is a side elevational view of the door of FIG. 1 showing the door after initial movement out of closed and locked position.

The numeral 10 generally designates the novel door of the preferred embodiment, and the numeral 12 designates the track means upon which the door 10 is supported on the side of a rail house car for movement from the locked and closed position shown in FIG. 1 to the partially open position shown in FIG. 2. The door 10 includes a top panel member 14, a center panel member 16 and a bottom panel member 18. A top edge member 20 is provided at the top edge of panel member 14 and a bottom edge member 22 is provided at the bottom edge member 18 to define the upper and lower extremities of the door.

To complete the rectangular structure of the door, a front or leading edge vertical member 24 and a rear or trailing edge vertical member 26 are provided. As will be best seen in FIG. 5, rear vertical reinforcing plate 28 and front vertical reinforcing plate 30 are provided to strengthen the door. The door is appropriately provided with a plurality of door handles 32.

A top edge angle 34 is provided, as by welding, to the top of the top edge member 20 and is received behind the lowermost flange of a top retaining z-shaped plate 36. The z-shaped retainer 36 extends across the top of the door opening and has a counterpart 38 which extends over the remainder portion of the track 12 not below the opening for door 10 in the car side. Top retainers 40 are provided in a manner known, for engagement with the front faces 39 of the top retainer z-plates, 36 and 38. A baffle 42 is provided at the upper corner of the door adjacent the front stop 44.

The vertically extending front stop 44 and the vertically extending rear combination post strip and post protection angle 46 define door side seals in cooperation with edge members 24 and 26. The front stop 44 and the combination post strip and post protection angle 46 are mounted on the front door post 48 and the rear door post 50 respectively. Both the top retainer plate 36 and a door header 52 are welded to the upper side plate 54. These create the top door seal with top edge member 20. Retainer plate 36 has a reinforcement member 55.

The bottom edge member 22 defines the bottom edge of the door and has an inwardly directed flange 60 with an upwardly directed inward end flange portion 62 and a bottom edge surface 64. On the inside of the upward flange portion 62, a bottom reinforcing plate 66 extends upwardly for riveted connection with panel member 18. Joining the flange portion 62 with the upper portion of rear edge member 22 is a roller housing support 68 welded in position. The roller housing support 68 together with a roller housing bracket 70 welded inside of edge member 22 are journelled at 72 and receive roller pins and lubrication fittings 74 which mount rollers 76 and **76*a*. The rollers 76 are of one diameter and the roller 76*a*** is of a smaller diameter for reasons which will become apparent later in this description.

The track 12, as illustrated, is provided with three openings or copes, front cope 80, adjacent cope **80*a* and rear cope 81. These copes are located in the top of the track 12 to correspond with the position of the rollers 76 and 76*a* when the door is in the closed and locked position with the rollers 76 and 76*a* extending through the openings 82 in the lower edge surface 64 of bottom door edge member 22**.

Figure 3:
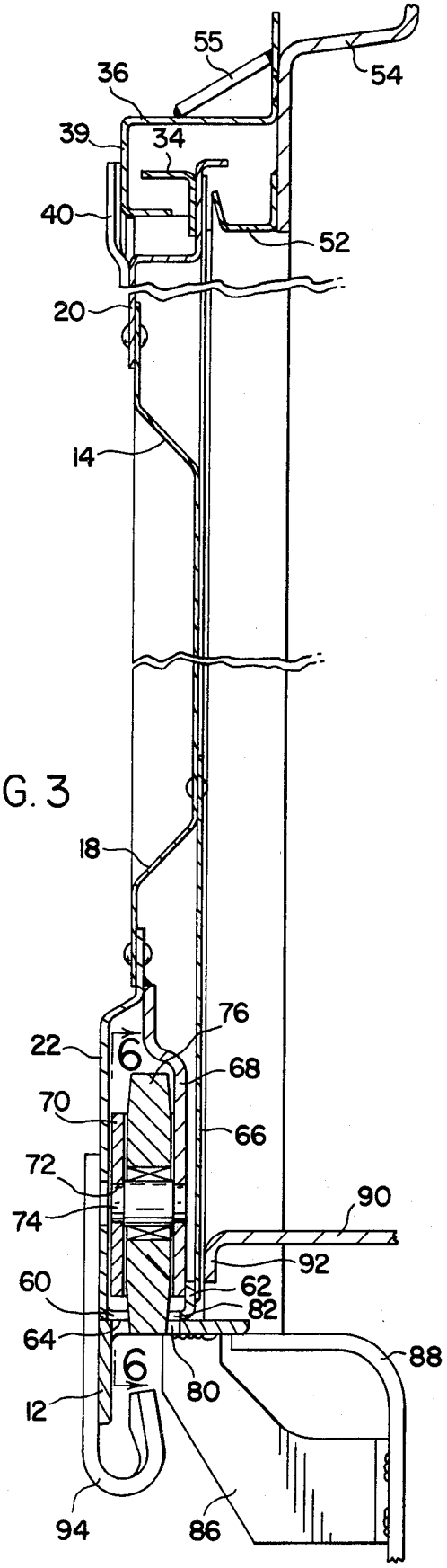
FIG. 3 is a cross-sectional view taken along the line 3—3 of FIG. 1.
Figure 4:
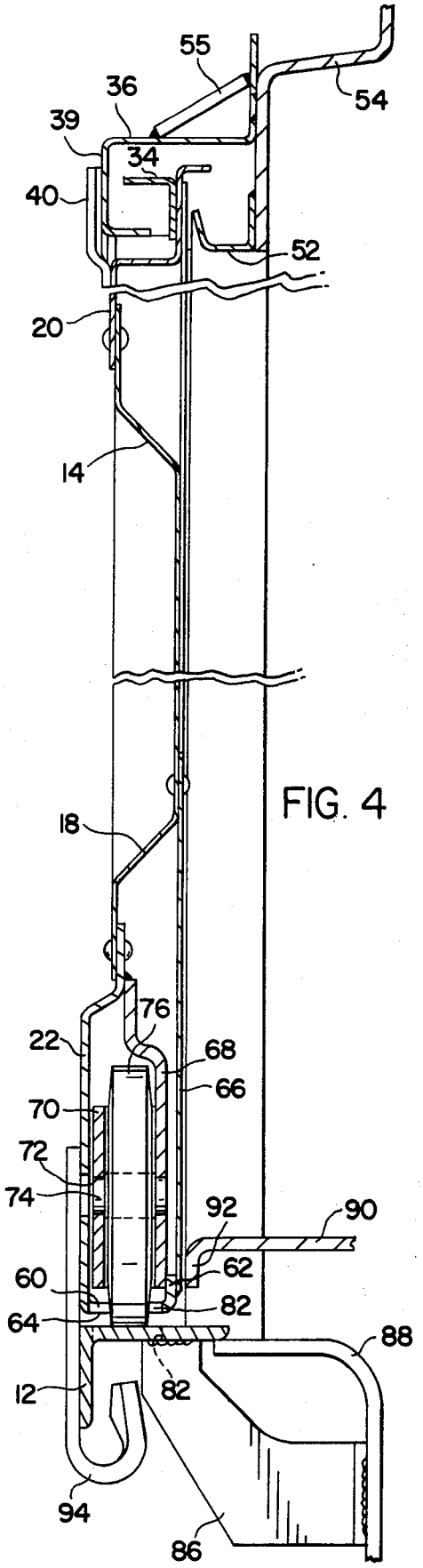
FIG. 4 is a cross-sectional view taken along the line 4—4 of FIG. 2.
Figure 5:
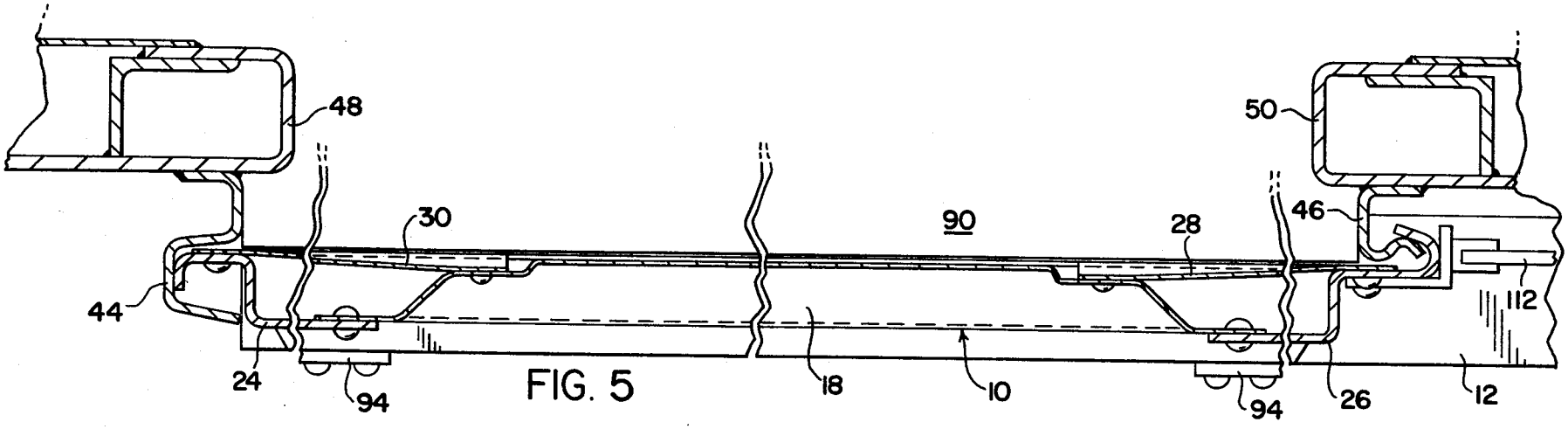
FIG. 5 is a cross-sectional view taken along the line 5—5 of FIG. 1.
Figure 6:
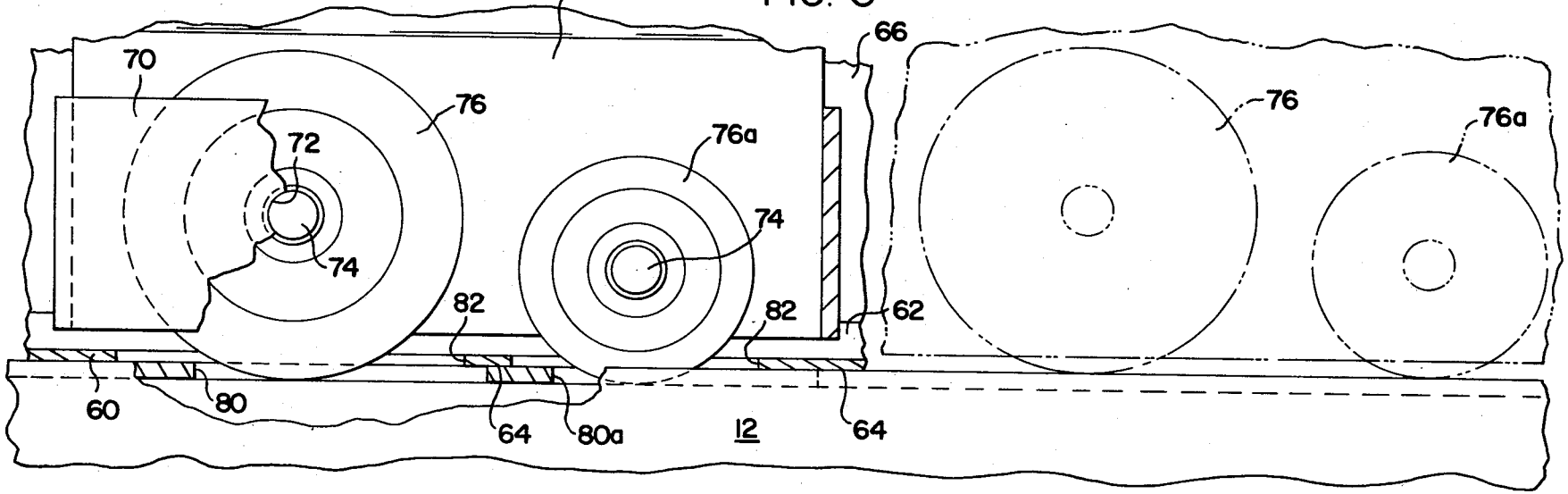
FIG. 6 is an expanded fragmentary elevational view taken along the line 6—6 of FIG. 3 illustrating the relationship of the rollers and copes in FIG. 1 with the relationship of the rollers and copes of FIG. 2 shown in phantom.

In the preferred embodiment, the front cope 80, adjacent cope **80*a* and rear cope 81 are of such longitudinal dimension and location as initially to permit the bottom edge surface 64 to rest on the top of the track 12 with the rollers 76 and 76*a* extending into their respective copes when the door leading edge member 24 is approximately 1¾" from its sealed position with front stop 44. The purpose of this cope dimensioning is to prevent the rollers from horizontally advancing the door into the fully closed and sealed condition as they roll into their respective copes thereby minimizing any likelihood a man's hand or clothing could inadvertently be caught between the leading edge 24 of the door and the front stop 44. This, in this preferred embodiment, the final small measure of travel takes place in the form of a short sliding action between the bottom surface 64 and the top of the track 12 as the door moves into the closed and sealed condition. As seen in FIGS. 3 and 5, the copes also have an enlarged lateral dimension such that during closing, a relatively small amount of final lateral sliding movement occurs due to the relative motion between members 24 and 44, and 26 and 46** respectively, to effect a seal in a manner well known to those skilled in the art.

When the door 10 is in the closed and locked position as shown in FIG. 1, for example, the rollers 76 and **76*a* extend from the openings 82 into the copes 80, 80*a* and 81 with the lower edge surface 64 of bottom edge member 22 laying directly on the top surface of track 12 and making a water-tight and light-tight seal therewith. It will be seen that the track 12 is welded to track brackets 86 which in turn are welded to the car side sill member 88. A threshold plate 90 with its downwardly turned flange 92 makes a further inner seal against the bottom reinforcing plate 66. The lower portion of the door is retained on track 12 by means of lower or bottom door retainers 94 which extend below and behind the vertical flange of the angled tracked member 12**, in a manner well known in the art.

To give the door its final small measure of travel into the closed, locked and sealed position and to remove the door from the closed, locked and sealed position, a force-multiplying member, such as a door driver having a rack and pinion mechanism, may be used. The door driver is one of several designs known and is generally designated by the numeral 100 in the drawings. It is selectively operably connected by means of a hasp 102 mounted on the front edge member 24 in a manner well known to those skilled in the art. In like manner, a hasp 104 is provided for selective engagement with an anti-pilferage lock 106 to lock the door in closed position. In addition to the door driver 100 and the generally designated anti-pilferage lock 106, a seal pin 108 is provided in connection with the hasp 102 for sealing the car. When the door is moved to its fully open position, it is provided with a hook assembly 110 mounted on the track for use with a selectively operated disengageable hold-open arm 112.

As an alternative to the door driver 100, the door may be opened by a pry bar inserted between a fulcrum member 114 welded to the car sill 88 below track 12 and leveraged against the bottom of a bottom retainer 94 to urge the door upwardly and in a direction down the track toward open position. Either force-multiplying means will move the door from the closed and locked condition to the initial open position shown in FIG. 2.

After the door driver 100 or pry bar and fulcrum 114 has been utilized to move the door to a position where the rollers 76 and **76*a* are no longer in the copes 80, 80*a* and 81 in the top of the track 12, the door is free to roll to the completely open condition where the hold-open device comprising the hold-open arm 112 and the hook bracket 110 will be utilized to hold the door open. Before the door 10 arrives at that position, however, the front roller 76 must pass over the copes 80*a* and 81 and roller 76*a* must pass over cope 81**.

It will be readily seen that because of the diameter of front roller 76, and because roller **76*a* and rear roller 76 are on the track, it will pass easily over the cope 80*a* which corresponds to roller 76*a* when the door is in the closed and locked position. As the roller 76*a* passes over the rear cope 81, the door is supported on the track by the front and rear rollers 76. As the front roller 76 reaches cope 81, it cannot drop into the cope because the door is supported by the smaller diameter roller 76*a* which has already passed over cope 81 and by rear roller 76**. Accordingly, at least two rollers, one in the front and one in the rear of the door, are on the track surface at all times after the door has left its initial position in the locked and closed condition.

A further advantage of this roller arrangement is that the door, when in the closed and locked position, even if not properly locked or secured by hasp 102 or 104, is not as likely to be damaged by free-rolling along the track 12 during movement of the car. This is because the rollers 76 and **76*a* will tend to stay in the copes 80, 80*a* and 81** to hold the door in that position.

For convenience in assembling the invention, a door lifting lug 120 is provided, and this can be grasped by a hook and crane cable as shown in phantom in FIG. 2.

Thus it will be seen that the instant invention provides a door which seals on its lower edge, does not require an elaborate lifting mechanism for movement along its track, yet retains an advantage that the track may be sealed throughout its length along the car side thus giving an excellent water and light seal of reduced maintenance requirement over that of the prior art.

What is claimed is:

1. In a railway house car having a door supporting track on a car side beneath a door opening, a door formed with a lower edge surface for support of said door on the top of said track in engagement with said track when said door is in position to close said opening, said lower edge surface extending substantially throughout the width of said door and having a plurality of at least three intermediate openings with portions of a plurality of at least three longitudinally spaced rollers extending therefrom, said track being in sealed contact with the car side beneath said door opening substantially throughout the length of said track and having a plurality of at least three corresponding intermediate copes of enlarged longitudinal dimension in the top of said track located to receive said rollers when said door is supported on said lower edge surface in position to sealingly engage said track to close and seal said opening, said copes' enlarged dimensions, during closing and just prior to the final movement of said door into position to close and seal said opening, permitting a final longitudinal sliding movement of said lower door edge surface on the top of said track to close and seal said opening, and during opening, permitting an initial relatively short longitudinal sliding movement of said lower door edge surface on said track to initially open said opening, and also permitting at least two of said rollers to engage the top of said track and support said door with the lower edge surface removed from said track for longitudinal movement when the door is in other positions on said track, said lower edge surface being located so as to define the inwardmost portion of the door adjacent said track such that in the closed position of the door a seal is provided with said track and potential damage to said track tending to move it closer to said car side cannot clamp any portion of said door between said track and said car side and thereby hinder selective door movement.

2. The railway house car of claim 1 in which a leverage-producing means is provided to effect the final longitudinal and lateral sliding movement of the door and to effect the initial sliding movement of the door out of the position in which it closes and seals said opening.

* * * * *